US006889825B2

(12) United States Patent
Ichikawa et al.

(10) Patent No.: US 6,889,825 B2
(45) Date of Patent: May 10, 2005

(54) OPHTHALMIC LENS STORAGE CONTAINER

(75) Inventors: Seiichi Ichikawa, Kakamigahara (JP); Hiroyuki Oyama, Kakamigahara (JP); Masayoshi Tanaka, Nagoya (JP)

(73) Assignee: Menicon Co., Ltd. (JP)

( * ) Notice: Subject to any disclaimer, the term of this patent is extended or adjusted under 35 U.S.C. 154(b) by 197 days.

(21) Appl. No.: 10/198,754

(22) Filed: Jul. 17, 2002

(65) Prior Publication Data

US 2003/0057111 A1 Mar. 27, 2003

(30) Foreign Application Priority Data

Jul. 17, 2001 (JP) ..... 2001-217080

(51) Int. Cl.[7] ..... B65D 75/36

(52) U.S. Cl. ..... 206/5.1; 206/210; 220/359.1; 220/359.2

(58) Field of Search ..... 206/5.1, 210, 316.1, 206/461, 467, 469, 470; 220/359.1–359.4

(56) References Cited

U.S. PATENT DOCUMENTS

| | | | | | |
|---|---|---|---|---|---|
| 4,605,142 | A | * | 8/1986 | Itoh et al. | 220/359.4 |
| 5,409,104 | A | * | 4/1995 | Lovell | 206/5.1 |
| 5,467,868 | A | * | 11/1995 | Abrams et al. | 206/5.1 |
| 5,609,246 | A | * | 3/1997 | Borghorst et al. | 206/5.1 |
| 5,704,468 | A | * | 1/1998 | Lust et al. | 206/5.1 |
| 5,722,536 | A | * | 3/1998 | Pierce et al. | 206/5.1 |
| 5,823,327 | A | * | 10/1998 | Wu et al. | 206/5.1 |
| 5,833,071 | A | * | 11/1998 | Ray | 206/532 |
| 5,983,608 | A | * | 11/1999 | Wu et al. | 53/478 |
| 6,050,398 | A | | 4/2000 | Wilde et al. | |
| 6,082,533 | A | * | 7/2000 | Smith et al. | 206/210 |
| 2003/0029736 | A1 | * | 2/2003 | Phillips et al. | 206/5.1 |

FOREIGN PATENT DOCUMENTS

| | | |
|---|---|---|
| EP | 0 223 581 A1 | 5/1987 |
| EP | 0 734 965 A1 | 10/1996 |
| JP | 62-122969 | 6/1987 |
| JP | 07-322911 | 12/1995 |
| JP | 09-23916 | 1/1997 |
| JP | 10-313928 | 12/1998 |
| WO | WO 94/244019 A | 10/1994 |

* cited by examiner

*Primary Examiner*—Jim Foster
(74) *Attorney, Agent, or Firm*—Rossi & Associates

(57) ABSTRACT

Disclosed is an ophthalmic lens storage container comprising: a container body including a lens storage portion having a cavity for storing a lens and a preserving solution, and a flange surrounding the cavity; and a cover sheet stripably sealed to the flange in a sealing zone that extends around the cavity to thereby fluid-tightly seal the lens storage portion. The flange of said container body includes an insulating portion located radially outward of an open-end peripheral portion of the cavity, extending circumferentially and includes a shoulder surface that extends in a first direction opposite to a second direction along which the cavity is exposed, and the sealing zone is located radially outward of the insulating portion of the flange.

18 Claims, 15 Drawing Sheets

OPHTHALMIC LENS STORAGE CONTAINER

INCORPORATED BY REFERENCE

The disclosure of Japanese Patent Application No. 2001-217080 filed on Jul. 17, 2001 including the specification, drawings and abstract is incorporated herein by reference in its entirety.

BACKGROUND OF THE INVENTION

1. Field of the Invention

The present invention relates generally to ophthalmic lens storage containers each having a lens storage portion for storing an ophthalmic lens such as a contact lens, more particularly to such an ophthalmic lens storage container having a novel structure to facilitate removal of the ophthalmic lens from the lens storage portion.

2. Description of the Related Art

A blister package is known as one type of a container for storing a contact lens. JP-A-7-322911, JP-A-9-23916, JP-A-10-313928 and U.S. Pat. No. 6,050,398 disclose known examples of the blister package that includes: a package body having a generally semi-spherical cavity and a flange extending radially outward around the periphery of the cavity; and a cover sheet formed of a plastic film, aluminum foil or the like. The cavity contains the contact lens and a preserving solution, and the cover sheet is stripably sealed to the flange in a sealing zone that extends around the periphery of the cavity, to thereby enclose the cavity.

The conventional blister package constructed as described above may suffer from a problem that the sealing zone formed in the flange of the package body is roughed once the cover sheet is stripped or peeled from the flange, being likely to cause undesirable generation of burrs or fuzz on the sealing zone extending around the periphery of the cavity. Generally, a user removes the lens from the cavity by sliding the lens up along the bottom surface and the open-end peripheral surface in this order, while pushing or gripping the lens by his or her fingers. Accordingly, the contact lens may come into contact with the burrs left on the sealing zone, and is likely to be damaged, e.g., occurrence of flaws or cracks on the surface of the lens, by the contact with the burrs. Especially, a contact lens of disposable type, which has relatively thin wall thickness and a low strength, is more likely to be damaged by the contact with the burrs, upon the removal of the lens from the lens storage container.

SUMMARY OF THE INVENTION

It is therefore an object of the invention to provide an ophthalmic lens storage container having a novel structure that permits a damage free removal of the ophthalmic lens such as a contact lens, while facilitating the removal of the lens.

The above and/or optional objects of this invention may be attained according to at least one of the following modes of the invention. Each of these modes of the invention is numbered like the appended claims and depending from the other mode or modes, where appropriate, to indicate possible combinations of elements or technical features of the invention. It is to be understood that the principle of the invention is not limited to these modes of the invention and combinations of the technical features, but may otherwise be recognized based on the teachings of the present invention disclosed in the entire specification and drawings or that may be recognized by those skilled in the art in the light of the present disclosure in its entirety.

(1) An ophthalmic lens storage container comprising: (a) a container body including a lens storage portion having a cavity for storing the ophthalmic lens and a preserving solution, and a flange extending radially outward around an open-end peripheral portion of the cavity; and (b) a cover sheet superposed on the container body for covering an opening of the cavity and being stripably sealed to the flange in a sealing zone that extends around the peripheral portion of the cavity over an entire circumference of the cavity, to thereby fluid-tightly seal the lens storage portion; wherein the flange of the container body includes an insulating portion located radially outward of the open-end peripheral portion of the cavity so as to extend circumferentially, the flange includes a shoulder surface that extends in a first direction opposite to a second direction along which the cavity is exposed; and wherein the sealing zone is located radially outward of the insulating portion of the flange.

The ophthalmic lens storage container constructed according to the present invention allows a lens user to remove the lens stored in the lens storage portion (e.g., a bottom surface of the cavity) by sliding up the lens along the bottom surface and the open-end peripheral surface in this order, while pushing or gripping the lens by his or her fingers, and to pick the lens up from the open-end peripheral portion and the flange by his or her fingers. In particular, the sealing zone in which the cover sheet is sealed to the flange is located radially outward of the insulating portion that is located radially outward of the open-end peripheral portion of the cavity, so that the sealing zone is effectively spaced apart from the cavity with the shoulder surface of the insulating portion interposed therebetween. This eliminates or reduces a possibility that the lens comes into contact with the sealing zone upon the removal of the lens from the lens storage portion, even if the sealing zone is roughed by stripping the cover sheet from the flange, and the burrs are undesirably generated on the sealing zone. That is, the ophthalmic lens storage container according to the present invention permits a removal of the contact lens with ease and safety while preventing the lens being damaged.

The cavity of the container body may be suitably designed and sized with no limitation to receive the lens and the sufficient quantity of sterile preserving solution to completely submerge the lens. The bottom surface of the cavity may be desirably shaped depending upon a specific configuration, size and the like of an ophthalmic lens to be received in the cavity. For instance, the bottom surface of the cavity may have a concave ball-like shape as disclosed in U.S. Pat. No. 6,050,398, a flat plate-like shape as disclosed in JP-62-122969, a convex ball-like shape as disclosed in JP-A-10-313928, or the like. Preferably, the container body may be formed of synthetic resin materials having a high strength and a high tolerance, in view of the cost and efficiency in manufacturing the container body and easiness in handling the material. Examples of these materials are fluororesin, polyamide, polyacrylate, polyethylene, polyethylene terephthalate, poly vinyl chloride, non-crystalline polyolefin, polycarbonate, polysulfone, polybutylene terephthalate, polypropylene, polymethyl pentene, and the like. These materials are adopted solely or alternatively in a composite body or a laminar structure. Also, the cavity may have a variety of shapes in plane view, including a circular shape, a polygonal shape, an ellipsoidal shape, a heart shape, and the like. The container body may further be provided with an upright rib or a peripheral upright wall for the purpose of reinforcement, a hole or a cutout for assisting the user in lifting up the cover sheet from the flange, and an irregular surface for ensuring a non-slip grip of the container body by the user. The cover sheet may be a single film or alternatively a multi-layered film, and any film may be adopted as the cover sheet as long as the film is capable of being sealed to the container body by bonding, welding or other similar methods. Preferably, the cover sheet may be formed of a synthetic resin materials indicated above as the possible materials of the container body, a metallic material such as aluminum, or composite materials composed of these synthetic resin material(s) and metal(s).

(2) An ophthalmic lens storage container according to the above-indicated mode (1), wherein the flange of the container body further includes a lower surface spaced away from the opening of the cavity in the first direction, the lower surface serving for providing the sealing zone. According to this mode of the invention, the surface of the sealing zone is spaced away from the surface of the open-end peripheral portion of the cavity along which the lens is slid upon the removal of the lens, in the first direction, i.e., in the height direction. This arrangement is effective to avoid that the lens comes into contact with the burrs generated on the sealing zone when being removed from the lens storage portion. In addition, since the surface of the open-end peripheral portion of the cavity and the surface of the sealing zone is spaced apart from each other by the shoulder surface of the insulating portion in the height direction, the sealing zone can be located closer to the open-end peripheral portion of the cavity as seen in a plane view, with the separation between the sealing zone and the open-end peripheral portion of the cavity being maintained by the shoulder surface in the height direction. Thus, the container body can be made compact in size.

(3) An ophthalmic lens storage container according to the above-indicated mode (1) or (2), wherein the insulating portion is constituted by a groove open in a front surface of the flange in which the cavity is open, and the shoulder surface is constituted by an inner circumferential wall surface of the groove. This mode of the invention can provide the ophthalmic lens storage container according to the above-indicated modes (1) or (2) in an efficient manner. The sealing zone may be located (i) radially outward of the groove of the flange, or alternatively (ii) in the bottom surface of the groove. In the former case (i), the groove is placed between the surface of the open-end peripheral portion of the cavity and the surface of the sealing zone, thereby firmly assuring the separation between these two surfaces. In the latter case (ii), the sealing zone and the burrs generated on the sealing zone due to the cover sheet stripped from the flange can be completely held within the groove, thereby effectively preventing undesirable contact of the lens with the burrs upon the removal of the lens. In this respect, the inner circumferential wall surface of the groove is located adjacent to the cavity and serves as the shoulder surface.

According to any one of the above-described modes (1)–(3) of the invention, the insulating portion located radially outward of the open-end peripheral portion of the cavity needs to be formed in a portion in the flange, which is intended to be used for the removal of the lens at least, and needs not to be formed over an entire circumference of the cavity.

(4) An ophthalmic lens storage container according to any one of the above-indicated modes (1)–(3), wherein the insulating portion, which is located radially outward of the open-end peripheral portion of the cavity, continuously extends over an entire circumference of the cavity. In this arrangement, any circumferential portion of the cavity can be served as a portion to be used for the removal of the lens.

(5) An ophthalmic lens storage container according to any one of the above-indicated modes (1)–(4), wherein the open-end peripheral portion of the cavity extends circumferentially with an outwardly curved shape in cross section. According to this mode of the invention, since the open-end peripheral portion of the cavity has a smoothly curved surface without edge, thereby eliminating possibility that the lens is scratched by such an edge when being removed from the cavity.

(6) An ophthalmic lens storage container according to any one of the above-indicated modes (1)–(5), wherein an inner surface of the cavity includes a central portion and an open-end side portion that serves as a removal-guide surface whose radius of curvature is made different from that of the central portion. In this mode of the invention, the removal-guide surface is suitably adjusted, thereby facilitating removal of the lens sliding along the removal-guide surface. A specific configuration of the removal-guide surface may be desirably determined by those skilled in the art while taking into account of efficiency in manufacturing the container body and a taste of users. In some instances, the removal-guide surface has an outwardly curved cross sectional shape in cross section that protrudes in the second direction, an inwardly curved shape that is recessed in the second direction or alternatively a gradient plane surface with a curvature of "0" that extends radially outwardly in the second direction. Described in detail, the removal-guide surface having the outwardly curved shape makes it easier to slide the lens along the removal-guide surface and pick up the lens from the removal-guide surface. The removal-guide surface having the inwardly curved cross-sectional shape with a radius of curvature that is smaller than a radius of curvature of the central portion of the cavity, allows the container body to be made compact in size without unduly enlargement of the lens storage portion, and allows the lens to be slid along the open-end peripheral portion of the cavity in a generally upright attitude, and to be readily removed from the lens storage portion. In the case where the principle of this mode (6) is adopted in combination with the principle of the aforesaid mode (5), the removal-guide surface may possibly be served as the open-end peripheral portion of the cavity, which extends circumferentially with the outwardly curved shape.

(7) An ophthalmic lens storage container according to the above-indicated mode (6), wherein the removal-guide surface consists of a plurality of segments having different radius of curvatures and being connected together in the second direction. This arrangement makes it possible to design the removal-guide surface with a great degree of freedom while taking into account of a user's taste and a material of the container body, as well as a size, kind, shape of the ophthalmic lens. These segments may smoothly join together along knots lying on tangents common to curves of these segments, or alternatively may discontinuously join together with junctions where no line tangents common to the curves of these segments. The removal-guide surface may comprise the plurality of segments that have different configurations, e.g., an outwardly curved shape in cross section, a tapered gradient surface, and an inwardly curved shape in cross section, and that join together to form the removal-guide surface. Alternatively, the removal-guide surface may comprise the plurality of segments that have the same configuration but have different radii of curvatures, and that join together to form the removal-guide surface.

According to any one of the aforesaid modes (5)–(7), the open-end peripheral portion of the cavity that extends circumferentially with an outwardly curved shape in cross section, and the removal-guide surface needs to be formed in a portion in the flange, which is intended to be used for the removal of the lens at least, and needs not to be formed over an entire circumference of the cavity. Further, the radius of curvature of the removal-guide surface may be constant over the entire circumference, or alternatively may desirably vary in the circumferential direction.

(8) An ophthalmic lens storage container according to the above-indicated mode (6) or (7), wherein the removal-guide surface continuously extends over an entire circumference of the cavity.

(9) An ophthalmic lens storage container according to any one of the above-indicated modes (1)–(8), wherein the insulating portion is located radially outward of the open-end peripheral portion of the cavity with a spacing in between, the spacing including a plane surface. According to this mode of the invention, the sealing zone can be widely spaced away from the open-end peripheral portion of the cavity, advantageously avoiding or minimizing undesirably contact of the lens with the sealing zone upon the removal of the lens from the container body.

(10) An ophthalmic lens storage container according to any one of the above-indicated modes (1)–(9), wherein at least one circumferential portion of the sealing zone protrudes radially outward with a beak-like shape to thereby provide a beak-like portion. In this mode of the invention, a stripping-off of the cover sheet begins at a tip end of the beak-like portion for reducing a stripping force required in opening the cover sheet, thus easing and smoothing the stripping-off of the cover sheet from the flange of the container body. Accordingly, a reaction in the container body against the stripping-off of the cover sheet is minimized, thus preventing that a relatively large amount of preserving solution is spilled from the opening of the cavity, and further facilitating removal of the lens. The configuration of the sealing zone is not particularly limited but suitably determined taking into account of a plane shape of the opening of the cavity. Furthermore, the width dimension of the sealing zone may be generally constant over its entire circumference, or alternatively vary suitably in the circumferential direction for desirably adjusting stripping strength of the cover sheet.

In addition, stripping characteristics of the cover sheet can be adjusted by regulating the ratio B/L of the width dimension B of the beak-like portion to the length L from the base to the tip of the beak-like portion. Preferably, the ratio B/L is determined not to be larger than 5 ($B/L<5$) for assuring that the cover sheet can be opened smoothly. It is possible that the beak-like portion protrudes radially outwardly from the sealing zone with a gradient, but the beak-like portion preferably protrudes radially outwardly in the right angle.

(11) An ophthalmic lens storage container according to any one of the above-indicated modes (1)–(10), wherein at least one circumferential portion of the sealing zone extends radially outward to thereby provide a seal-retaining portion that allows the cover sheet, which is partially stripped from the flange to expose the cavity substantially entirely, to be retained in the flange. According to this mode of the invention, after the sealed cavity is opened, the cover sheet is still sealed at the seal retained portion and held in sealed to the container body, making it possible to handle the opened container body and the cover sheet as an integral member. Preferably, the dimension of the seal-retaining portion is sufficiently made larger in a direction perpendicular to a direction in which the cover sheet is stripped from the flange than other directions, thereby effectively preventing undesirably separation of the cover sheet from the container body upon the opening of the storage container. In the ophthalmic lens storage container provided with the seal-retaining portion according to the present mode of the invention, the cover sheet is desirably formed of a specific material so that the cover sheet partially stripped off from the flange to expose the cavity is held in its deformed state where the cover sheet is still secured at the seal-retaining portion in a generally upright attitude to keep the cavity open.

(12) An ophthalmic lens storage container according to the above-indicated mode (10), wherein the sealing zone extend radially outward to provide a seal-retaining portion at another circumferential portion that is opposed to the at least one circumferential portion where the beak-like portion is provided with the cavity interposed therebetween, the seal-retaining portion allows the cover sheet, which is partially stripped from the flange including the beak-like portion of the sealing zone to expose substantially entirely the cavity, to be retained in the flange. According to this mode of the invention, the beak-like portion permits a smooth start of the stripping-off of the cover sheet, while the seal-retaining portion effectively prevents undesirable separation of the cover sheet from the container body, for example when the cover sheet is stripped off abruptly from the container body. Accordingly, a reaction in the container body against the stripping-off of the cover sheet is further minimized or eliminated, thereby permitting a stable opening of the cavity.

(13) An ophthalmic lens storage container according to the above-indicated mode (12), wherein the sealing zone includes a pair of the beak-like portions formed at respective circumferential positions thereof opposed to each other with the cavity interposed therebetween, and one of the pair of beak-like portions serves as the seal-retaining portion. In this arrangement, the storage container can be opened from any sides of the opposite beak-like portions, leading to an improved practicability of the storage container. Moreover, the unopened beak-like portion can serve as the seal-retaining portion, thus establishing the effects of the seal-retaining portion, which were discussed above with respect to the aforesaid mode (12).

BRIEF DESCRIPTION OF THE DRAWINGS

The foregoing and/or optional objects features and advantages of the invention will become more apparent from the following description of a preferred embodiment with reference to the accompanying drawings in which like reference numerals designate like elements and wherein.

DETAILED DESCRIPTION OF PREFERRED EMBODIMENTS

Figure 1:
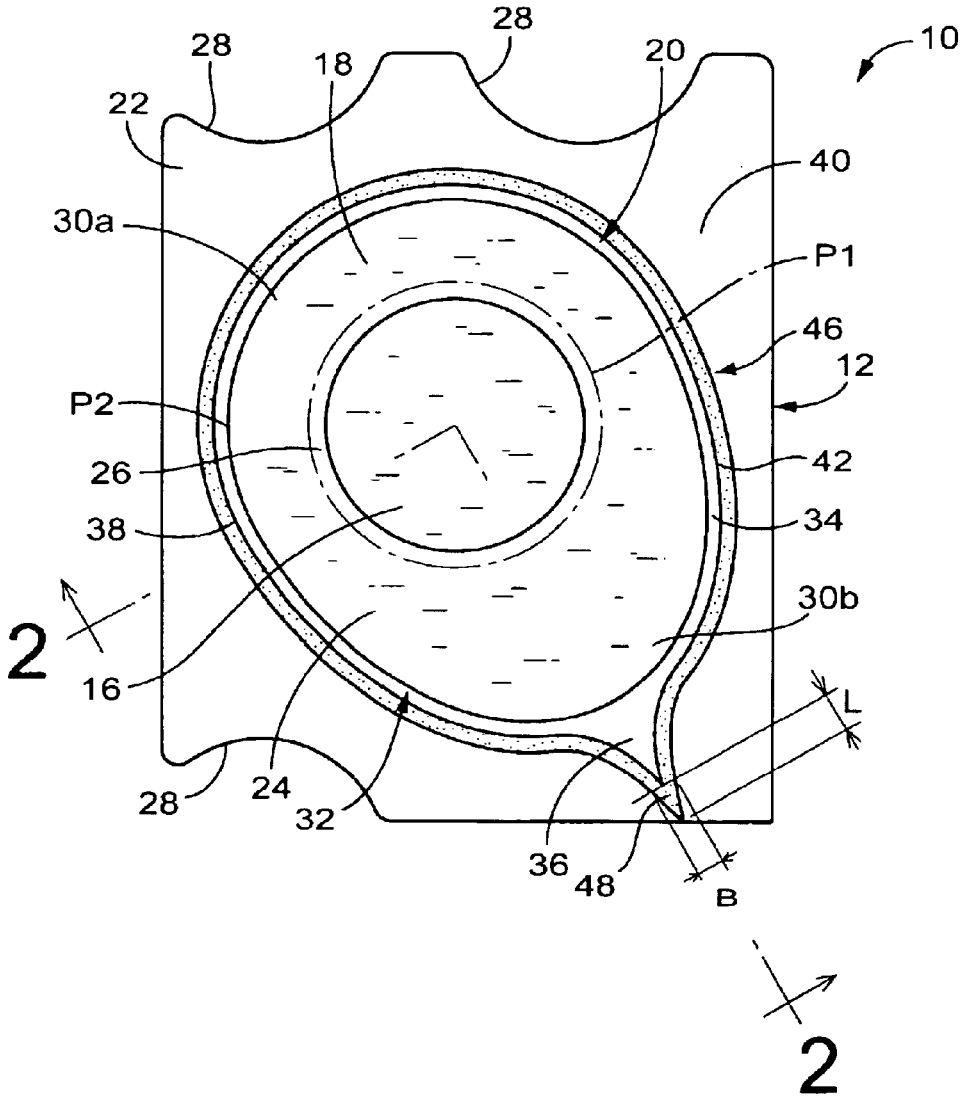
FIG. 1 is a top plane view of an ophthalmic lens storage container in the form of a blister package according to a first embodiment of the present invention, where a cover sheet of the blister package is not secured.
Figure 2:
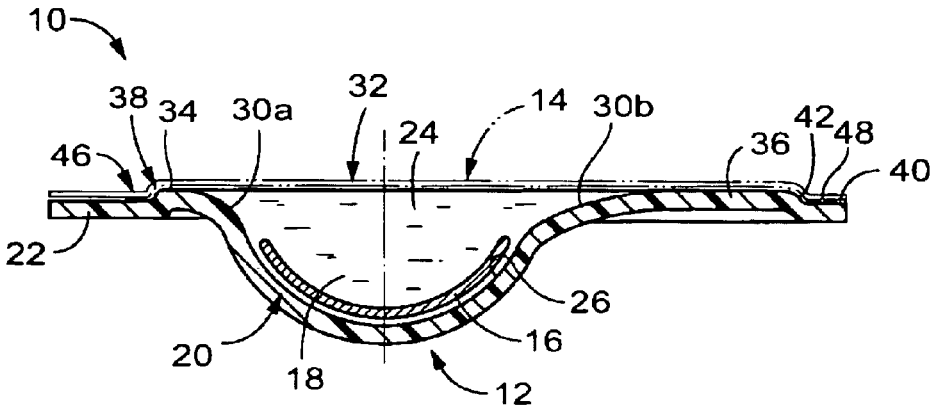
FIG. 2 is a cross sectional view taken along line 2—2 of FIG. 1.

Referring first to FIGS. 1 and 2, a blister package 10 is shown as a first embodiment of the ophthalmic lens storage container of the present invention. The blister package 10 includes a container body 12 and a cover sheet 14. The container body 12 stores a contact lens 16 and a preserving solution 18. The cover sheet 14 is stripably sealed to the container body 12, whereby the contact lens 16 is fluid-tightly enclosed in the container body 12 and can be removed from the container body 12 as needed.

The container body 12 includes a lens storage portion 20 surrounded by a flange 22, and is formed of a synthetic resin material such as polypropylene and polyethylene by injection molding or the like. The lens storage portion 20 has a semi-spherical shell shape that is made somewhat flat in a thickness direction, and a cavity 24 with a round bottom is formed within the lens storage portion 20. An inner surface of a bottom portion of the lens storage portion 20, i.e., an inner surface of a central portion of the cavity 24 is hereinafter referred to as a bottom surface 26. This bottom surface 26 is a spherical concave surface whose radius of curvature R1 is substantially made constant (see FIG. 3). The flange 22 has a thin-walled rectangular flat plate shape, and is integrally formed at an open-end peripheral portion of the cavity 24 so as to extend outwardly in a radial direction perpendicular to an axial or vertical direction as seen in FIG. 2. Hereinafter, the axially or vertically upward direction is referred to as a "second direction" along which the cavity 24 is open, and the axially or vertically downward direction is referred to as a "first direction in which a shoulder surface 42, which will be described later, extends. Also, the flange 22 is provided in its peripheral portion with three cutouts 28 different in size. Each cutout 28 has a generally semi-circular shape as seen in FIG. 1 to help a user grip the container body 12 by his or her fingers.

As shown in FIGS. 1 and 2, the lens storage portion 20 serves for storing the contact lens 16 and the preserving solution 18, and the cavity 24 is substantially fully filled with the preserving solution 18 that is enough to completely submerge the contact lens 16. The kinds and materials of the contact lens 16 and the preserving solution 18 are not particularly limited. In the present embodiment, for example, the contact lens 16 may be a soft hydrophilic contact lens made of copolymers of hydroxyethle methacrylete (HEMA), and the preserving solution 18 may be a solution capable of preventing dehydration and maintaining the contact lens 16 in a ready to wear condition, and specific examples are a sterile aqueous solution and an isotonic saline solution.

A guide surface 30 for helping removal of the contact lens 16 is formed in the open-end peripheral portion of the cavity 24 that constitutes the outer peripheral portion of the lens storage portion 20. This guide surface 30 is smoothly connected to the bottom surface 26, and extends circumferentially with an outwardly curved or convex shape in cross section that protrudes outwardly in the second direction along which the cavity 24 is open.

Figure 3:
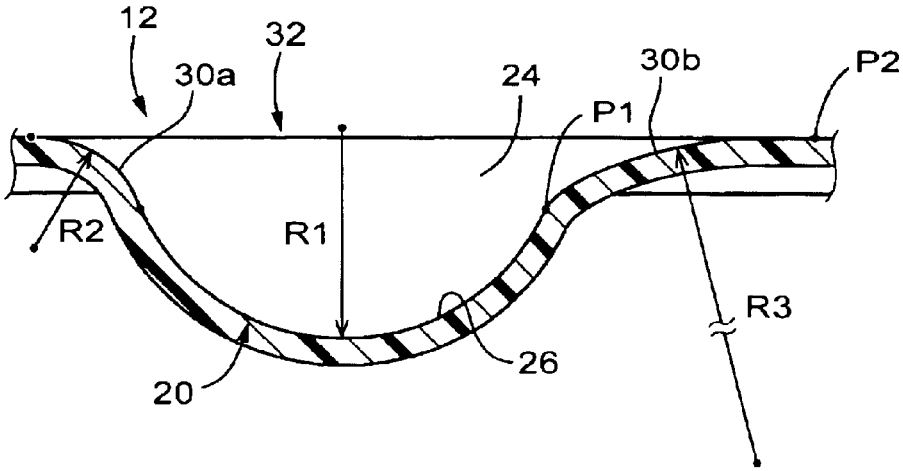
FIG. 3 is a fragmentally enlarged view in cross section of a principle part of the blister package of FIG. 1.
Figure 4:
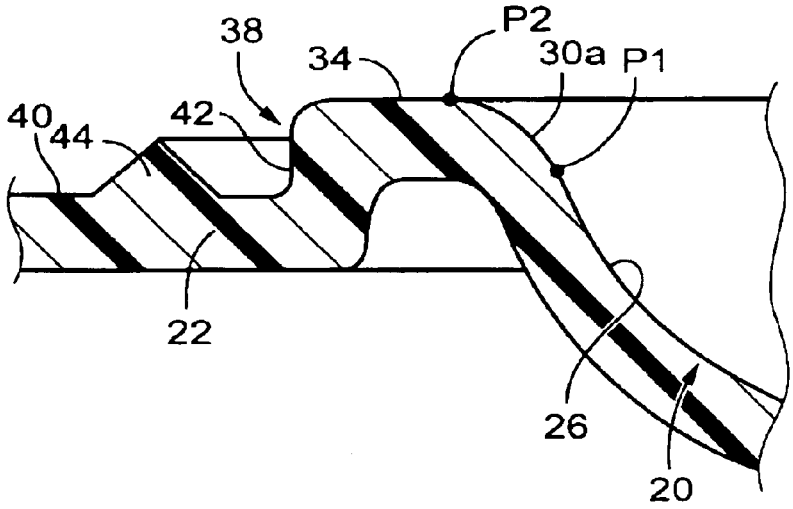
FIG. 4 is a fragmentally enlarged cross sectional view for explaining one step of manufacturing a container body of the blister package of FIG. 1.

The radius of curvature of the removal guide surface 30 varies in the circumferential direction, as shown in FIGS. 1 and 3. Described in detail, the guide surface 30 consists of guide surface halves 30*a*, 30*b*. The guide surface half 30*a* is contiguous to one semi spherical portion (left oblique upper part as seen in FIG. 1) of the bottom surface 26, and has a radius of curvature R2 that is made substantially constant over about a half of the circumference thereof. The guide surface half 30*b*, on the other hand, is contiguous to the other semi spherical portions (right oblique lower part as seen in FIG. 1) of the bottom surface 26, and has a radius of curvature R3 that is made larger than the radius of curvature R2 of the guide surface half 30*a*. The bottom surface 26 with the radius of curvature R1 and the guide surface half 30*a* with the radius of curvature R2 join together along knots P1 lying on tangents common to these surfaces 26, 30*a*, while the bottom surface 26 with the radius of curvature R1 and the guide surface half 30*b* with the radius of curvature R3 join together along knots P1 lying on tangents common to these surfaces 26, 30*b*. In this arrangement, an amount of extension of the guide surface 30 in the radially outward direction is made large at one circumferential position located in the right-hand lower portion as seen in FIG. 1, whereby the curve of the guide surface half 30*b* at the circumferential position is made more moderate or smooth than the curve of the guide surface half 30*a*. In the plane view shown in FIG. 1, the outer peripheral portion of the guide surface 30, which defines an opening 32 of the cavity 24, has an egg-like shape where the right-hand lower portion extends radially outwardly. That is, the opening 32 of the cavity 24 has the egg-like shape where a first circumferential portion (located in the right-hand lower end portion as seen in FIG. 1) opposed to a second circumferential portion (located in the left-hand upper end portion as seen in FIG. 1) in a major axis direction has a radius of curvature that is made smaller than that of the second circumferential portion. It should be appreciated that the flange 22 has a generally rectangular shape, while the guide surface 30*b* functioning as an intended lens removal portion is approximately directed to a diagonal direction of the flange 22, whereby the guide surface 30 can be effectively extended in the generally diagonal direction, while avoiding an undue enlargement of the size of the container body 12.

The guide surface 30 is surrounded by a plane surface 34. The plane surface 34 extends in a direction perpendicular to the second direction along which the cavity 24 is open, and is formed continuously to surround the opening 32 of the cavity 24 over the entire circumference. The curves of the guide surface halves 30*a*, 30*b* with the respective radius of curvatures R2, R3, and the plane surface 34 join together at knots P2 lying on lines tangent to the curves and lying on the plane surface 34. The width dimension of the plane surface 34 is made generally constant over its entire circumference.

The plane surface 34 includes an acute projection 36 formed on the side of the first circumferential portion of the opening 32 of the cavity 24 where the radius of curvature is made smaller in plane view to be extended outwardly.

Further, a lower surface 40 is disposed radially outward of the plane surface 34 via a shoulder portion 38 functioning as an insulating portion. The shoulder portion 38 includes a shoulder surface 42 that is contiguous to the outer peripheral portion of the plane surface 34 and extends contiguously to surround the plane surface 34 over its entire circumference. The shoulder surface 42 extends in the above-mentioned first direction opposite to the second direction along which the cavity 24 is open, to be connected to the lower surface 40. The lower surface 40 extends in the radially outward direction perpendicular to the first and second directions, and is formed continuously over its entire circumference. The outer peripheral portion of the lower surface 40 serves as an outer peripheral portion of the flange 22. That is, the lower surface 40 is located downward of the plane surface 34 by the height dimension of the shoulder surface 42 in the axial or vertical direction as seen in FIG. 1, and radially outward of the plane surface 34 in the flange 22. As is understood from the aforesaid description, the plane surface 34, the lower surface 40 and the shoulder portion 38 cooperate to define the flange 22 of the container body 12.

On the other hand, the cover sheet 14 may be formed of a laminate sheet made of a composite material composed of an aluminum foil and a synthetic resin material, by way of example, and has an outside profile conforming to a shape of the upper surface of the container body 12. The cover sheet 14 may be stripably sealed to the container body 12 by heat-sealing, for instance. Described in detail, a projection 44 is integrally formed in advance on the lower surface 40 of the container body 12 for use in sealing the cover sheet 14 to the flange 22 by heat-sealing. This projection 44 is disposed on the lower surface 40 and located near the shoulder surface 42, while extending circumferentially continuously to surround the opening 32 of the cavity 24 over the entire circumference with a generally constant triangular shape in cross section and a generally constant width dimension. For securing the cover sheet 14 to the container body 12, the cover sheet 14 is superposed on the tip end face of the projection 44, and then the surface of the cover sheet 14 is pushed onto the container body 12 by means of a suitably heat application member for use in welding, whereby the cover sheet 14 is secured to the container body 12 by means of the projection 44 that is mashed and fusion-welded between the cover sheet 14 and the container body 12. In the present embodiment, the projection 44 is mashed and fusion-welded in the process of heat-sealing to form a sealing zone 46 right round the shoulder portion 38 at which the cover sheet 14 is sealed to the container body 12, and the sealing zone 46 can be separated from the plane surface 34 in the axial or vertical direction as seen in FIG. 1. That is, the sealing zone 46 is substantially insulated from the guide surface 30 and the plane surface 34, in the present embodiment.

The sealing zone 46 includes a beak-like portion 48 which is located radially outward of the acute projection 36 of the plane surface 34, and which has an acute projection shape. The beak-like portion 48 may have a variety of shapes and sizes, but not be limited specifically. Preferably, the shape and size of the beak-like portion 48 are suitably changed by adjusting the ratio of B/L of the width dimension B at the base of the beak-like portion 48 to the length L from the base to the tip of the beak-like portion 48, in order to make it easy to strip off the cover sheet 14. More preferably, the ratio B/L is determined to be smaller than 5 ($B/L<5$) for assuring excellent performance in stripping off the cover sheet 14. In the present embodiment, for example, the ratio B/L is made smaller than 1 ($B/L<1$).

As indicated by two-dot chain line in FIG. 2, the cover sheet 14 is sealed to the container body 12 with its central portion being raised in the vertically upward or in the second direction by means of the shoulder portion 38, as a result of the heat-sealing where the cover sheet 14 is superposed on the upper surface of the container body 12 and secured to the welded projection 44. Thus, the cover sheet 14 fluid-tightly seals the opening 32 of the cavity 24. In this respect, the container body 12 stores the contact lens 16 and the preserving solution 18 in advance, and then the cover sheet 14 is sealed to the flange of the container body 12, thereby providing the blister package 10 according to the present invention. The cover sheet 14 may be printed or affixed with desired information or design as needed.

In the blister package 10 constructed according to the present embodiment, the sealing zone 46 at which the cover sheet 14 is sealed to the flange of the container body 12 is located axially or vertically downward of the plane surface 34 as seen in FIG. 2 by the shoulder portion 38 interposed therebetween in the vertical direction. This makes it possible to eliminating or reducing a possible problem that the lens comes into contact with the sealing zone 46 when being removed from the lens storage portion, even if the sealing zone 46 is roughed by stripping the cover sheet 14 from the flange and burrs are undesirably generated on the sealing zone 46. Therefore, the contact lens 16 is less likely to be damaged when being removed from the lens storage portion 20, thereby assuring an excellent removal of the contact lens 16 from the container body 12.

In the present embodiment, the guide surface 30 gives the convex or outwardly curved surface at the open-end peripheral portion of the cavity 24, and no edge is formed on the open-end peripheral portion of the cavity 24, thereby eliminating possible damage of the contact lens 16 caused by being scratched by the open-end peripheral portion of the cavity 24.

Moreover, the guide surface 30 is smoothly connected to the bottom surface 26 of the cavity 24 and the plane surface 34 at the all knots P1, P2 with a smooth or junctionless curve. This arrangement allows the contact lens 16 to be smoothly slid up along the bottom surface 26, the guide surface 30 and the plane surface 34 in this order.

In the present embodiment, only the first circumferential portion of the opening of the cavity 24 (located in the right-hand lower end portion as seen in FIG. 1) is intended to be used for the removal of the lens, namely is designated as a intended lens removal portion, so that the radius of curvature of the guide surface 30 can be made smaller at the other circumferential portion of the opening of the cavity 24, thereby making the entire size of the opening 32 of the cavity 24 in the plane surface compact or small. On the other hand, the radius of curvature of the guide surface 30 is made larger at the first circumferential portion, whereby the contact lens 16 can be readily removed from the cavity 24 by sliding the contact lens 16 up the guide surface 30.

Since the plane surface 34 having a wide width is interposed between the guide surface half 30*b* and the shoulder portion 38, the plane surface 34 functions to prevent the contact lens 16 slid along the guide surface 30 being dropped downward from the outer peripheral portion of the guide surface 30 (or the shoulder portion 38) to the lower surface 40, thereby assuring an excellent removal of the contact lens 16 from the container body 12. Further, the plane surface 34 allows the cover sheet 14 to be held in close contact with the plane surface 34 with high stability, whereby the cover sheet 14 can fluid-tightly seal the opening 32 of the cavity 24 with excellent fluid-tight sealing in between.

Yet further, the beak-like portion 48 of the sealing zone 46 makes it possible to minimize a stripping force required in opening the cover sheet 14, thus allowing the user to begin to strip off the cover sheet 14 to open the cavity 24 with a relatively small stripping force. Accordingly, a reaction in the container body 12 against the stripping-off of the cover sheet 14 is minimized, thus preventing that a relatively large amount of preserving solution 18 is spilled from the opening 32 of the cavity 24, thereby assuring an excellent removal of the contact lens 16 from the container body 12 in a further effective manner.

Still further, the cover sheet 14 can be sealed to the container body 12 by effecting the heat sealing at the projection 44 formed on the container body 12, in the present embodiment, the sealing zone 46 can be desirably formed with high preciseness and stability, assuring an improved production efficiency and an improved fluid-tight sealing in an effective manner.

There will be next described some blister packages constructed according to other preferred embodiments of the present invention, by way of example. In the following description, the same reference numerals as used in the first embodiment will be used in the following embodiments to identify the corresponding components, and redundant description of these components will not be provided.

Figure 5:
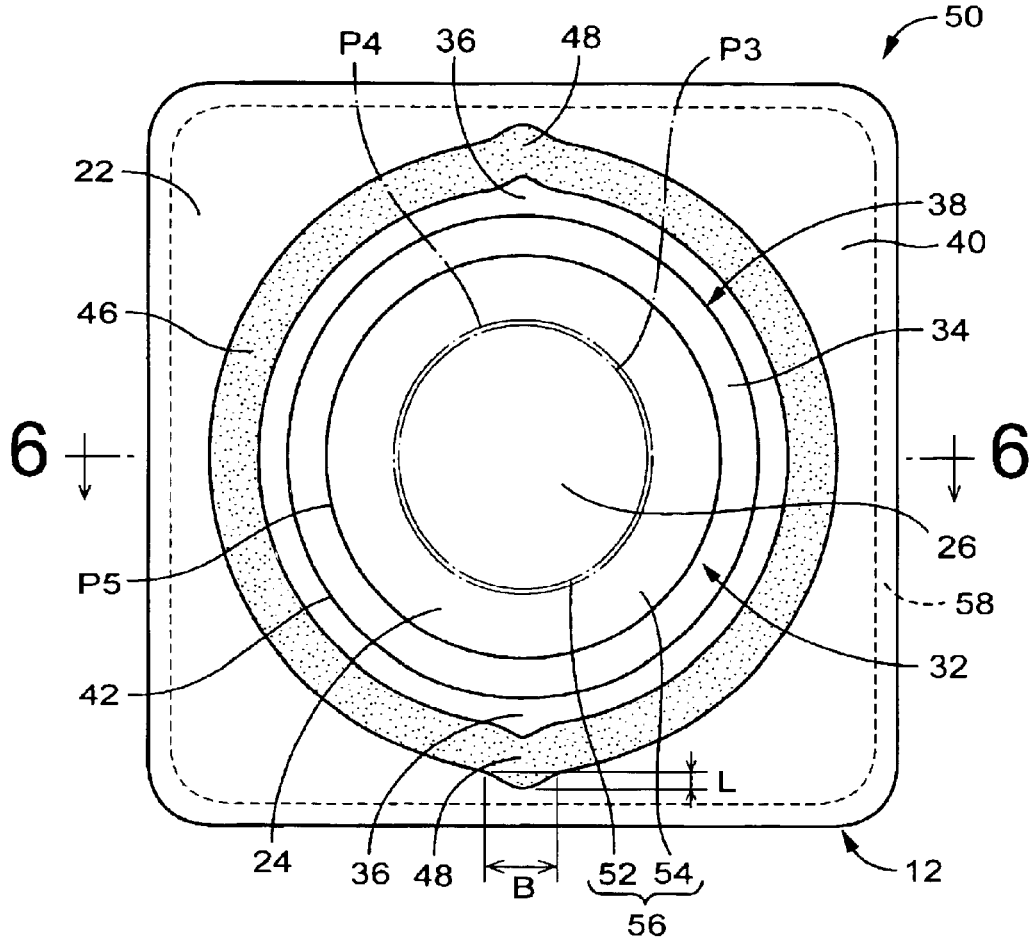
FIG. 5 is a top plane view of a blister package according to a second embodiment of the invention, where a cover sheet of the blister package is not secured.
Figure 6:
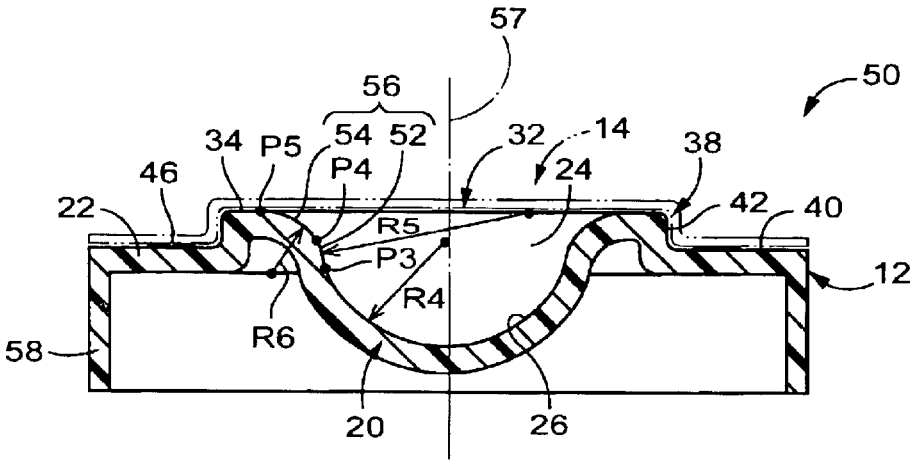
FIG. 6 is a cross sectional view taken along line 6—6 of FIG. 5.

Referring next to FIGS. 5–6, a blister package 50 is shown as a second embodiment of the ophthalmic lens storage container the present invention. The blister package 50 is different from the blister package 10 of the first embodiment as to (i) the shape of the guide surface, and (ii) the shape of the open-end peripheral portion in the opening 32 of the cavity 24.

In the blister package 50 of the present embodiment, the cavity 24 has a concave surface 52 in an open-end side portion located near the opening 32. The concave surface 52 has a radius of curvature R5 that is made larger than a radius of curvature R4 of the bottom surface 26. Namely, the concave surface 52 has an inwardly curve shape in cross section, which curve extends slightly radially outwardly in the second direction along which the cavity 24 is open. This concave surface 52 and the bottom surface 26 join together smoothly along knots P3 lying on tangents common to these surfaces 52, 26. Also, the cavity 24 has a chamfered surface 54 provided in the open-end peripheral portion of the cavity 24 which might provide an edge. The chamfered surface 54 has an outwardly curved shape in cross section, thereby removing the possible edge on the open-end peripheral portion of the cavity 24. Specifically, the chamfered surface 54 has a parabolic shape in cross section whose radius of curvature R6 gradually increases toward the outer peripheral portion of the opening 32. The inner peripheral portion of the chamfered surface 54, where the radius of curvature is made smaller, is connected to the outer peripheral portion of the guide surface 52 along knots P4 lying on tangents common to curves of these surfaces 54, 52, while the outer peripheral portion of the chamfered surface 54, where the radius of curvature is made larger, is connected to the plane surface 34 along knots P5 lying on lines tangent to the curve of the chamfered surface 54 and lying on the plane surface 34. Namely, in the present embodiment, the guide surface 56 includes two segments, i.e., the concave surface 52 and the chamfered surface 54, which have different radius of curvatures. It is noted that the chamfered surface 54 serves as the segment of the guide surface 30, as well as the open-end peripheral portion of the cavity 24 extending circumferentially with the outwardly curved shape in cross section to be convex in the second direction along with the cavity 24 is open.

The cavity 24, the guide surface 56 consisting of the concave surface 52 and the chamfered surface 54, the plane surface 34 and the shoulder surface 42 are all shaped as a solid of revolution about a center axis 57 of the cavity, whose cross sectional shape is made constant over the entire circumference about the center axis. The flange 22, which is contiguous to the shoulder surface 42, has a generally square shape in a plane view. For the purpose of reinforcement, the flange 22 includes a peripheral upright wall 58 integrally formed at the peripheral portion of the flange 22 so as to extend downwardly, and circumferentially over the entire periphery of the flange 22. The protruding end of the peripheral upright wall 58 is located downward of the bottom of the lens storage portion 20 in the vertical direction, so that the peripheral upright wall 58 functions as a support member. The sealing zone 46 formed on the flange 22 has a generally annular shape as seen in FIG. 5, and is located radially outward of the shoulder surface 42 so as to surround the shoulder surface 42 over the entire circumference while having a generally constant width. Like the first embodiment, the sealing zone 46 may be formed when the cover sheet 14 is heat sealed to the flange 22, where the cover sheet 14 is superposed on the projection 44 integrally formed on the flange 22, and then the surface of the cover sheet 14 is heat pressed onto the flange 22, whereby the cover sheet 14 is fusion-welded to the projection 44.

The sealing zone 46 includes a pair of beak-like portions 48, 48 formed on the respective circumferential portions diametrically opposed to each other. Each of the beak-like portions 48, 48 is arranged to have the length L in the protruding direction is made smaller than the length L in the beak-like portion 48 in the first embodiment, and the ratio B/L of the width dimension B of the beak-like portion at the base to the length L from the base to the tip of the beak-liked portion is arranged to be substantially equal to 5 (B/L≈5).

In the present embodiment, the shape and size of the open-end peripheral portion of the cavity 24 that includes the guide surface 56 and the plane surface 34 are not particularly limited, but may be suitably determined taking into account of the material, shape and size of the contact lens 16 and efficiency in using and manufacturing the blister package. Some specific examples of the open-end peripheral portion of the cavity 24 will be described in detail in conjunction with FIGS. 7–12. It should be appreciated that the invention is by no means limited to the details of the following examples.

Figure 7:
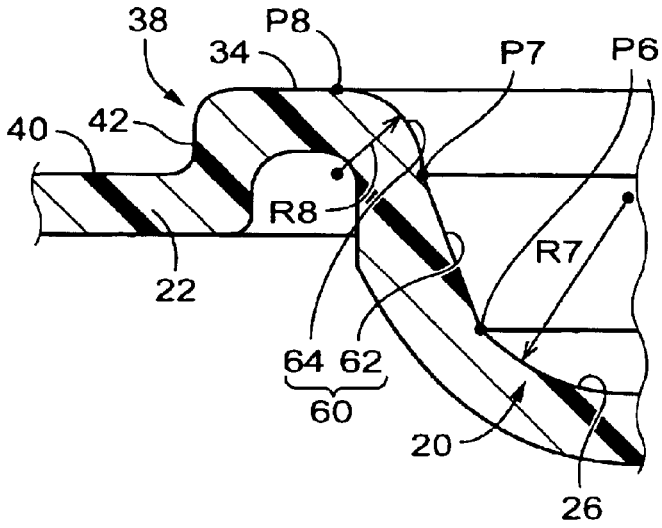
FIG. 7 is a fragmentally enlarged cross sectional view for showing one example of a guide surface adoptable in a blister package of the invention.

FIG. 7 shows a guide surface 60 partially defining the open-end peripheral portion of the cavity 24. The guide surface 60 is shaped as a solid of revolution about a center axis of the cavity 24, and consists of two parts, namely a sloped surface 62 as a first segment and a chamfered surface 64 as a second segment. The sloped surface 62 is discontinuously connected to the bottom surface 26 having a radius of curvature R7 along knots P6 with a peak or a junction. As seen in the cross section of FIG. 7, the sloped surface 62 extends straightly from the knots P6 with a generally constant slope in the second direction, i.e., in the vertically upward direction as seen in FIG. 7, and the chamfered surface 64 has an outwardly curved shape in cross section, protruding outward in the second direction and having a relatively small radius of curvature R8. The chamfered surface 64 is discontinuously connected to the sloped surface 62 along knots P7 with a peak created, while being smoothly connected to the plane surface 34 along knots P8 without creating any peak or junction.

Figure 8:
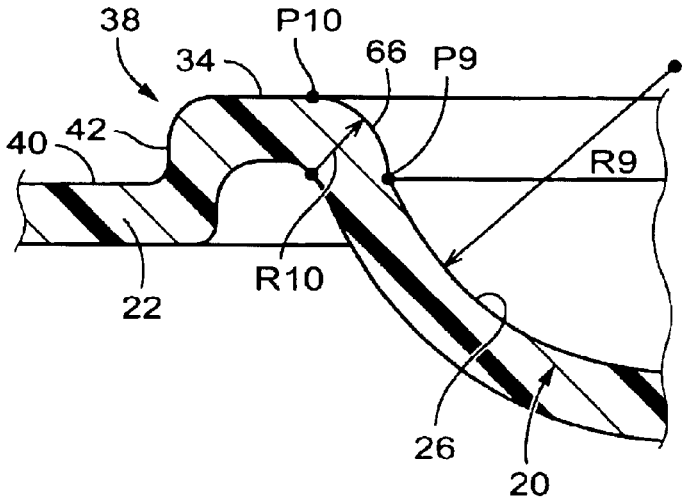
FIG. 8 is a fragmentally enlarged cross sectional view for showing another example of a guide surface adoptable in a blister package of the invention.

FIG. 8 shows a guide surface 66 partially defining the open-end peripheral portion of the cavity 24. The guide surface 66 is shaped as a solid of revolution about a center axis of the cavity 24, and has an outwardly curved or convex shape in cross section that protrudes outwardly in the second direction and has a radius of curvature R10 that is made smaller than a radius of curvature R9 of the bottom surface 26 of the cavity 24. The guide surface 66 is discontinuously connected to the bottom surface 26 along knots P9 with a peak created, while being smoothly connected to the plane surface 34 along knots P10 without creating any peak. As is understood from the foregoing description, the guide surface 66 serves as a chamfered surface provided to eliminate possible edge of the open-end peripheral portion of the cavity 24.

Figure 9:
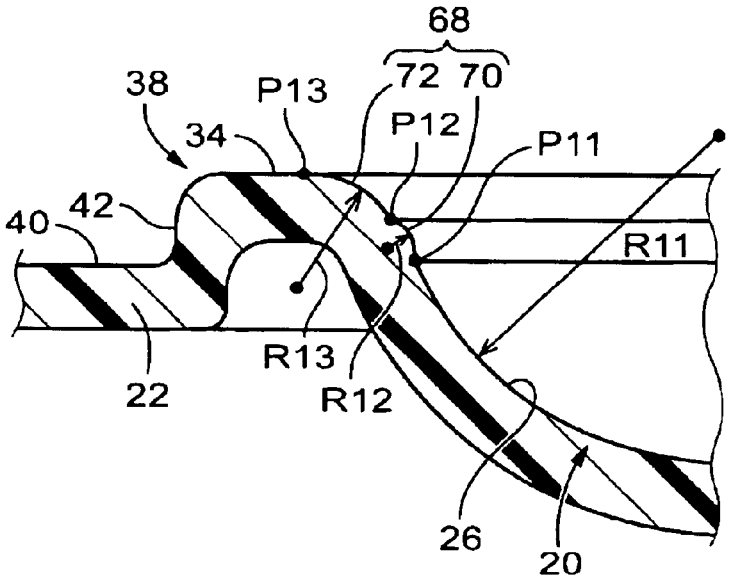
FIG. 9 is a fragmentally enlarged cross sectional view for showing yet another example of guide surface adoptable in a blister package of the invention.

FIG. 9 shows a guide surface 68 partially defining the open-end peripheral portion of the cavity 24. The guide surface 68 consists of two parts, namely an outwardly curved surface 70 as the first segment and a chamfered surface 72 as the second segment. The outwardly curved surface 70 has a convex shape in cross section to protrude outwardly in the second direction, and has a radius of curvature R12 that is made sufficiently smaller than a radius of curvature R11 of the bottom surface 26 of the cavity 24. The outwardly curved surface 70 is discontinuously connected to the bottom surface 26 along knots P11 with a peak created. The chamfered surface 72 has an outwardly curved or convex shape in cross section to protrude outwardly in the second direction, and has a radius of curvature R13 that is made larger than the radius of curvature R12 of the outwardly curved surface 70 and smaller than the radius of curvature R11 of the bottom surface 26. The chamfered surface 72 is discontinuously connected to the outwardly curved surface 70 along knots P12 with a peak created, while being smoothly or continuously connected to the plane surface 34 along knots P13 without creating any peak.

Figure 10:
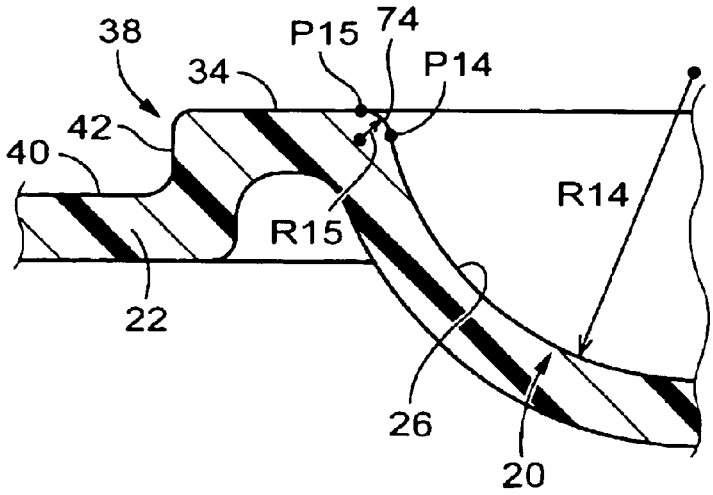
FIG. 10 is a fragmentally enlarged cross sectional view for showing still another example of guide surface adoptable in a blister package of the invention.

FIG. 10 shows the open-end peripheral portion of the cavity 24 where a chamfered surface 74 is provided. The chamfered surface 74 has an outwardly curved or convex shape in cross section to protrude outwardly in the second direction, and has a radius of curvature R15 that is made sufficiently smaller than a radius of curvature R14 of the bottom surface 26. The chamfered surface 74 continuously extends in the circumferential direction over the entire circumference of the cavity 24. The chambered surface 74 is smoothly and continuously connected at its inner periphery to the bottom surface 26 along knots P14 lying on tangents common to surfaces 74, 26, and at its outer periphery to the plan surface 34 along knots P15 lying on lines tangent to the chamfered surface 74 and lying on the plane surface 34. The radius of curvature R15 of the chamfered surface 74 may be suitably adjusted to be served as a guide surface that defines the open-end side portion of the cavity 24.

Figure 11:
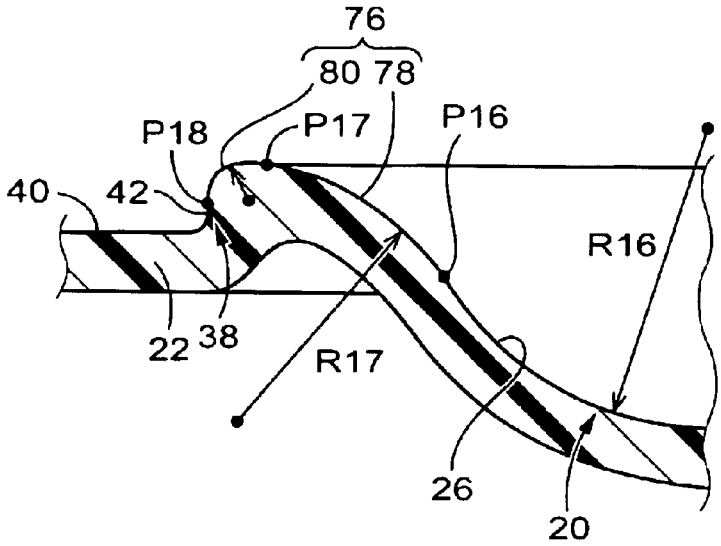
FIG. 11 is a fragmentally enlarged cross sectional view for showing a further example of guide surface adoptable in a blister package of the invention.

FIG. 11 shows a guide surface 76 partially defining the open-end peripheral portion of the cavity 24. The guide surface 76 consists of two parts, namely a first chamfered surface 78 as the first segment and a second chamfered surface 80 as the second segment. The first chamfered surface 78 has an outwardly curved or convex shape in cross section to protrude outwardly in the second direction, and has a radius of curvature R17 that is made smaller than a radius of curvature R16 of the bottom surface 26. The first chamfered surface 78 is continuously connected to the bottom surface 26 along knots P16 without creating any peak or junction. The second chamfered surface 80 has an outwardly curved or convex shape in cross section to protrude outwardly in the second direction, and has a radius of curvature R18 that is made smaller than the radius of curvature R17 of the first chamfered surface 78. The second chamfered surface 80 is smoothly connected at both sides thereof to the first chamfered surface 78 and the shoulder surface 42 of the shoulder portion 38 along knots P17, P18 with no peak created, respectively. That is, in this specific example, the guide surface 78 and the shoulder surface 42 of the shoulder portion 38 directly smoothly join together, without disposing the plane surface 34 in between.

Figure 12:
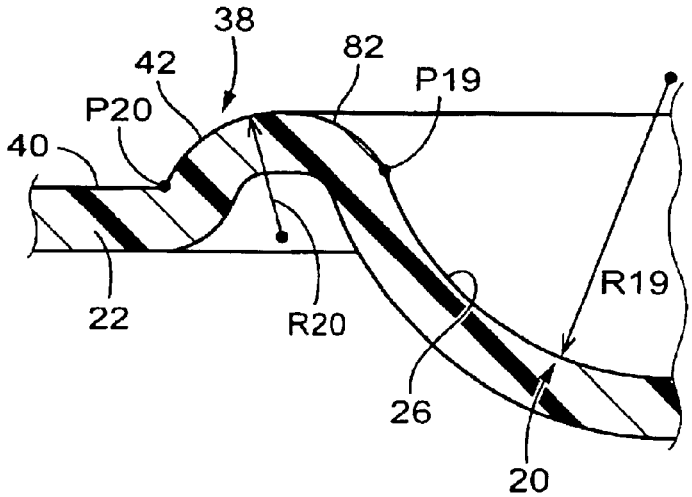
FIG. 12 is a fragmentally enlarged cross sectional view for showing a still further example of guide surface adoptable in a blister package of the invention.

FIG. 12 shows the open-end peripheral portion of the cavity 24 where a chamfered surface 82 is provided. The chamfered surface 82 has an outwardly curved or convex shape in cross section to protrude outwardly in the second direction, and has a radius of curvature R20 that is made smaller than a radius of curvature R19 of the bottom surface 26. The chamfered surface 82 is continuously or smoothly connected to the bottom surface 26 along knots P19 with no peak created, while being discontinuously connected to the lower surface 40 of the flange 22 along knots P20 with a peak created. That is, in this specific example, the chamfered surface 82 serves as a guide surface at its inner circumferential portion, while functioning at its outer peripheral portion to form the shoulder surface 42 of the shoulder portion 38.

In the illustrated second embodiment, the shape and sizes of the beak-like portion 48 of the sealing zone 46 is not particularly limited, but may be preferably determined or adjusted with materials, shapes, and sizes or other suitable parameters of the container body 12 and the cover sheet 14 taken into consideration. Some examples of the beak-like portions adoptable in the present invention will be described in conjunction with FIGS. 13–15.

Figure 13:
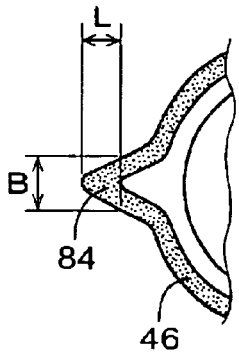
FIG. 13 is a fragmentally enlarged cross sectional view for showing one example of a beak-like portion adoptable in a blister package of the invention.
Figure 14:
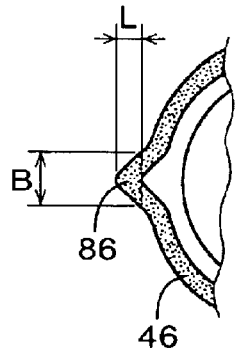
FIG. 14 is a fragmentally enlarged cross sectional view for showing another example of a beak-like portion adoptable in a blister package of the invention.
Figure 15:
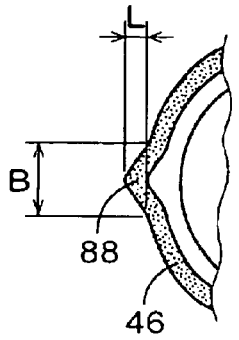
FIG. 15 is a fragmentally enlarged cross sectional view for showing yet another example of a beak-like portion adoptable in a blister package of the invention.

FIG. 13 shows a beak-like portion 84 formed in one circumferential portion of the sealing zone 46 designated as an intended stripping start point, where the ratio B/L is determined to satisfy the following inequality, $1<B/L<2$. FIG. 14 shows a beak-like portion 86 formed in one circumferential portion of the sealing zone 46 designated as an intended stripping start point, where the ratio B/L is determined to satisfy the following inequality, $2<B/L<3$. FIG. 15 shows a beak-like portion 88 formed in one circumferential portion of the sealing zone 46 designated as an intended stripping start point, where the ratio B/L is determined to satisfy the following inequality, $3<B/L<4$.

In the blister package 50 constructed according to the second embodiment as described above, the sealing zone 46 at which the cover sheet 14 is stripably sealed to the container body 12, is located axially or vertically downward of the plane surface 34 by the shoulder portion 38 interposed therebetween in the vertical direction as seen in FIG. 6, like the blister package 10 of the first embodiment. Therefore, the blister package 50 can enjoy the same advantages of the present invention, which are described above with respect to the blister package 10, and is capable of preventing the contact lens being damaged when being removed from the container body 12.

According to the second embodiment of the invention, the suitable one of the illustrated examples of the guide surface as shown in FIGS. 7–12 can be adopted, thereby facilitating or actively inducing removal of the contact lens by sliding the contact lens over the bottom surface 26 and the guide surface in this order.

Further, the sealing zone 46 includes the pair of beak-like portions 48, 48 opposed to each other in one diametric direction. In this arrangement, the blister package 50 can be opened from any side of the pair of beak-like portions 48, 48, and unsealed one of the pair of the beak-like portions 48, 48 can serve as a seal-retaining portion, resulting in improved efficiency in using and manufacturing the blister package 50.

Figure 16:
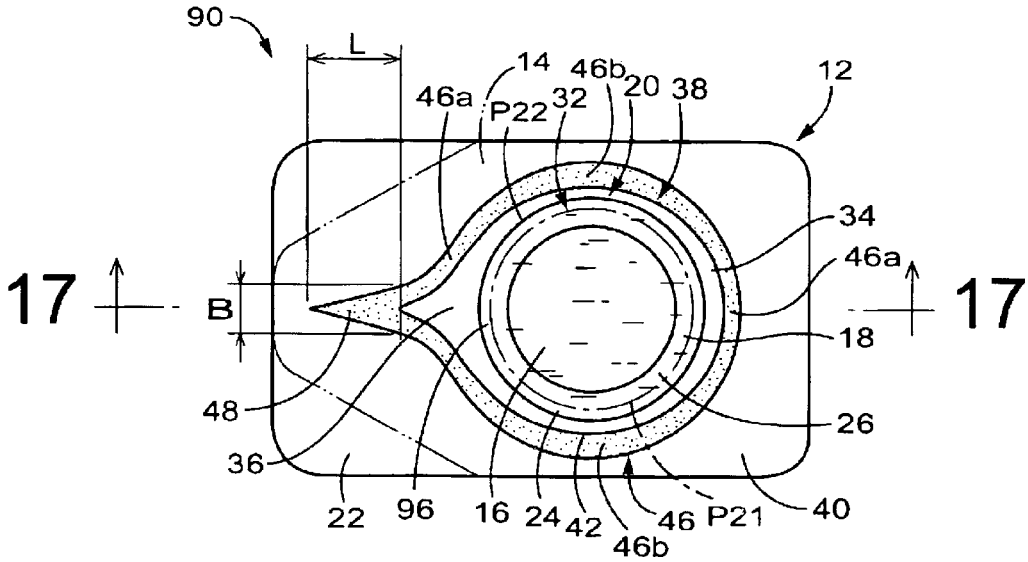
FIG. 16 is a top plane view of a blister package according to a third embodiment of the invention, where a cover sheet of the blister package is not secured.
Figure 17:
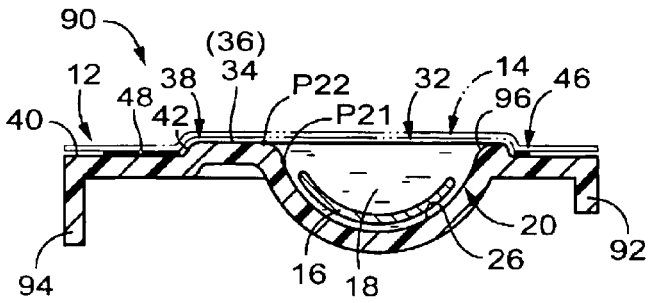
FIG. 17 is a cross sectional view taken along line 17—17 of FIG. 16.

Referring next to FIGS. 16 and 17, a blister package 90 is shown as a third embodiment of the ophthalmic lens storage container of the present invention. The blister package 90 is different from the blister packages 10; 50 according to the first and second embodiments in terms of the width dimension, the shape and the like of the sealing zone 46.

In the blister package 90 constructed according to the present embodiment, the lens storage portion 20 has a generally semi-spherical shell shape in its entirety, and a generally semi-spherical cavity 24 is formed within the storage portion 20. The flange 22 has a generally rectangular configuration in a plane view shown in FIG. 16, and an upright rib 92 for reinforcing the container body 12 and a grip member 94 for helping a stripping operation are integrally formed at opposite sides of a peripheral portion of the flange 22 so as to extend in the vertically downward direction as seen in FIG. 17.

A guide surface 96 is provided in the open-end peripheral portion of the cavity 24 so as to continuously extend circumferentially over the entire circumference of the cavity with a substantially constant outwardly curved or convex shape in cross section that protrudes outward in the second direction with a generally constant radius of curvature that is smaller than that of the bottom surface 26 of the cavity 24. The guide surface 96 is smoothly connected to the bottom surface 26 along knots P21 lying on tangents common to these surfaces 26, 96, while being smoothly connected to the plane surface 34 along knots P22 lying on lines tangent to the guide surface 96 and lying on the plane surface 34. The opening 32 of the cavity 24 has a generally circular shape. As is understood from the aforesaid description, the guide surface 96 may be formed as a chamfered surface to eliminate an edge in the open-end peripheral portion of the cavity 24.

While the plane surface 34 is connected to the guide surface 96 at its inner circumferential surface over the entire circumference, the width dimension of the plane surface 34 varies in the circumferential direction so that the outer peripheral portion of the plane surface 34 surrounds the opening 32 of the cavity 24 with a generally ellipsoidal shape. One of two circumferential portions opposed to each other in a major axial direction of the plan surface 34, extends outwardly to form the acute projection 36.

Further, the outer periphery of the sealing zone 46 formed on the lower surface 40 is shaped in a generally circular shape, although the inner periphery of the sealing zone 46 is made ellipsoidal. As a result, the width dimension of the sealing zone 46 varies in the circumferential direction. Namely, a width dimension as measured in circumferential positions 46*a*, 46*a* opposed in a major axial direction of the sealing zone 46 is made smaller than a width dimension as measured in circumferential positions 46*b*, 46*b* opposed in a minor axial direction of the sealing zone 46. In the present embodiment, the major axial direction conforms to a direction along which the cover sheet 14 is intended to be stripped off, and the circumferential portions 46*b*, 46*b* opposed to the minor axial direction perpendicular to the major axial direction have the maximized width dimension.

The blister package 90 constructed according to the present embodiment is characterized in that the width dimension of the sealing zone 46 is desirably changed in the circumferential direction, making it possible to adjust a stripping force required in opening the cover sheet 14. For instance, it is also possible to even the stripping force for opening the cover sheet 14 over the entire circumference.

Figure 18:
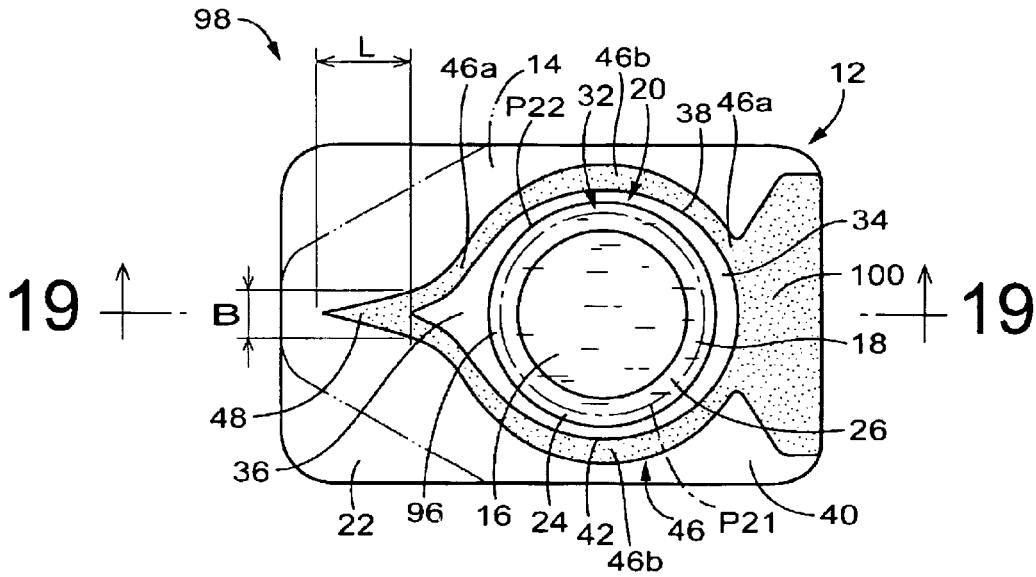
FIG. 18 is a top plane view of a blister package according to a fourth embodiment of the invention, where a cover sheet of the blister package is not secured.
Figure 19:
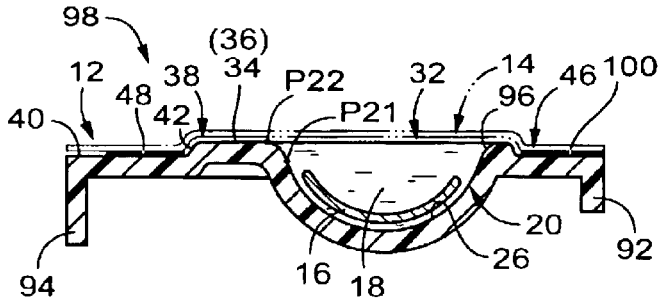
FIG. 19 is a cross sectional view taken along line 19—19 of FIG. 18.

Referring next to FIGS. 18 and 19, a blister package 98 is shown as a fourth embodiment of the ophthalmic lens storage container of the present invention. This blister package 98 is different from the blister package 90 according to the illustrated third embodiment of the invention in that a seal-retaining portion 100 is additionally formed.

The seal-retaining portion 100 is formed in a circumferential portion of the sealing zone 46, which portion is opposed to the beak-like portion 48 with the opening 32 of the cavity 24 interposed therebetween, so as to extend radially outwardly with a given width dimension. The seal-retaining portion 100 has a generally rectangular shape in a plane view shown in FIG. 18, and extends to the outer peripheral portion of the flange 22. The width dimension of the seal-retaining portion 100 is made substantially equal to or larger than the dimension of the opening 32 of the cavity 24.

In the blister package 98 constructed according to the present embodiment, since the seal-retaining portion 100 is formed on the opposite side of the beak-like portion 48, the sealing portion 100 can prevent or restrict the cover sheet 14 being stripped off from the container body 12 in an accelerative manner at the opposite side of the beak-like portion 48, making it possible to expose the opening 32 of the cavity 24 in a stable manner. Also, the seal-retaining portion 100 permits the partially stripped cover sheet 14 for opening the cavity 24 to be still sealed to the container body 12, making it easy to handle the container body 12 and the cover sheet 14 after the blister package 98 is opened.

Figure 20:
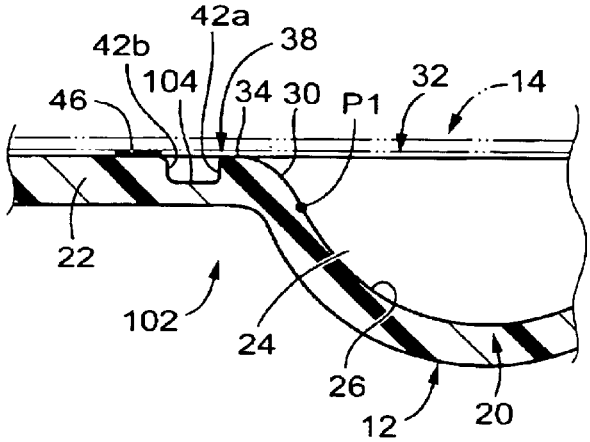
FIG. 20 is a fragmentally enlarged view in cross section of a blister package according to a fifth embodiment of the invention.

Referring next to FIG. 20, there is shown a principle part of a blister package 102 constructed according to a fifth embodiment of the ophthalmic lens storage container of the present invention in an enlarged manner. The blister package 102 is different from the first embodiment, as to the structure of the insulating portion having a shoulder surface extending in the first direction opposite to the second direction along which the cavity 24 is open.

Described in detail, the blister package 102 according to the present invention does not have the lower surface 40, and the flange 22 and the plane surface 34 are generally made flush with each other.

In the present embodiment, a groove 104 functioning as an insulating portion is formed in a portion of the flange 22 adjacent to the plane surface 34. The groove 104 is open in the upper surface of the flange 22 and extends circumferentially so as to surround the opening 32 of the cavity 24 continuously. That is, the groove 104 is partially defined by an inner circumferential wall 42*a* and an outer circumferential wall 42*b*, and the inner circumferential wall 42*a* functions as the shoulder surface 42.

The sealing zone 46 is formed in a portion of the flange 22, which is located radially outward of the groove 104. That is, the sealing zone 46 is separated from the guide surface 30 and the plane surface 34 by means of the groove 104 interposed therebetween, thereby being substantially insulated from the guide surface 30 and the plane surface 34.

Figure 21:
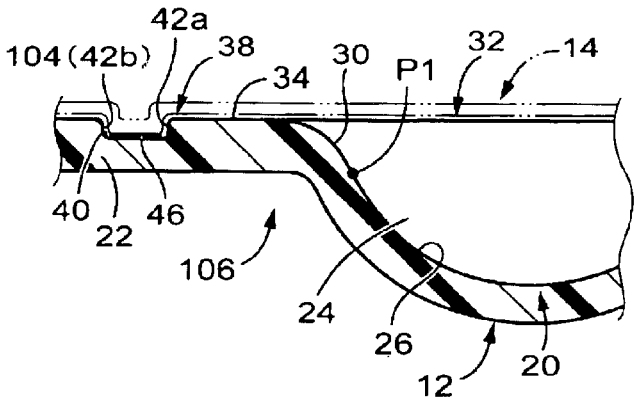
FIG. 21 is a fragmentally enlarged view in cross section of a blister package according to a sixth embodiment of the invention.

Referring next to FIG. 21, there is shown a principle part of a blister package 106 constructed according to a sixth embodiment of the ophthalmic lens storage container of the present invention in an enlarged manner. The blister package 106 is different from the fifth embodiment, as to the position of the sealing zone 46.

In the blister package 106 of the present embodiment, the sealing zone 46 is formed on the bottom surface of the groove 104, and the inner circumferential wall 42*a* separates the sealing zone 46 and the plane surface 34 in the height or vertical direction as seen in FIG. 21, whereby the sealing zone 46 is substantially insulated from the guide surface 30 and the plane surface 34. In the present embodiment, the bottom surface of the groove 104 provides a lower surface.

The blister package 106 constructed as described above can enjoy the same advantages of the present invention explained above with respect to the illustrated embodiments. In addition, the groove 104 completely houses the sealing zone 46 and prevents protrusion of the sealing zone 46 from the flange 22. This arrangement, for example, permits the cover sheet 14 to be readily printed, in a later step.

Figure 22:
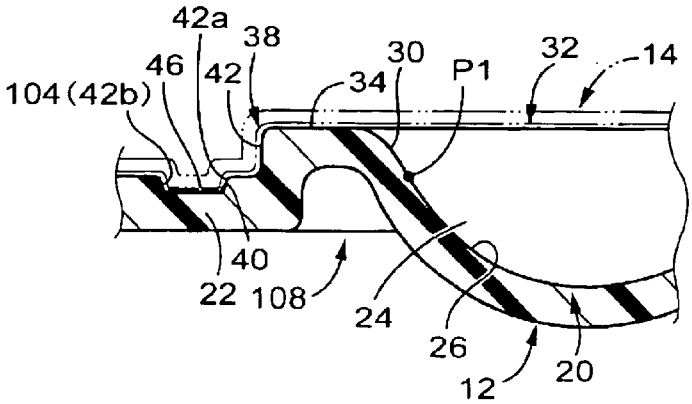
FIG. 22 is a fragmentally enlarged view in cross section of a blister package according to a seventh embodiment of the invention.

Referring next to FIG. 22, there is shown a principle part of a blister package 108 constructed according to a seventh embodiment of the ophthalmic lens storage container of the present invention in an enlarged manner. The blister package 108 is different from the blister package 10 of the first embodiment in that the sealing zone 46 at which the cover sheet 14 is sealed to the container body 12, is formed on the bottom surface of the groove 104 that is formed in the flange 22 and located radially outward of the shoulder portion 38. In the present embodiment, the bottom surface of the groove 104 provides a lower surface. In this arrangement, the sealing zone 46 is spaced away from the plane surface 34 by means of the shoulder surface 42 of the shoulder portion 38 and the inner circumferential wall 42*a* of the groove 104 functioning as the shoulder surface 42, in the height or vertical direction as seen in FIG. 22, thereby being substantially insulated from the guide surface 30 and the plane surface 34.

Figure 23:
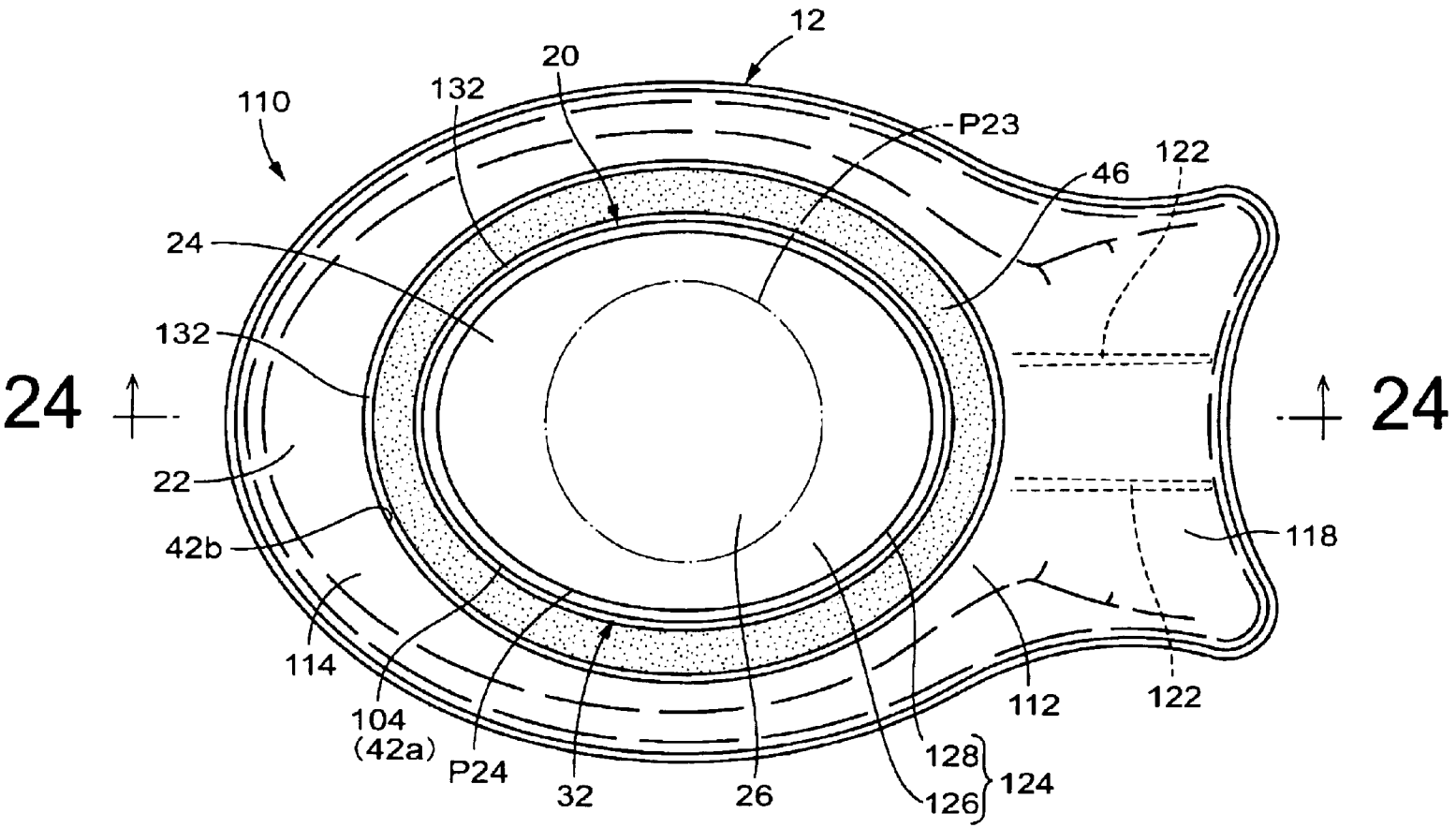
FIG. 23 is a fragmentally enlarged view in cross section of a blister package according to an eighth embodiment of the invention.
Figure 24:
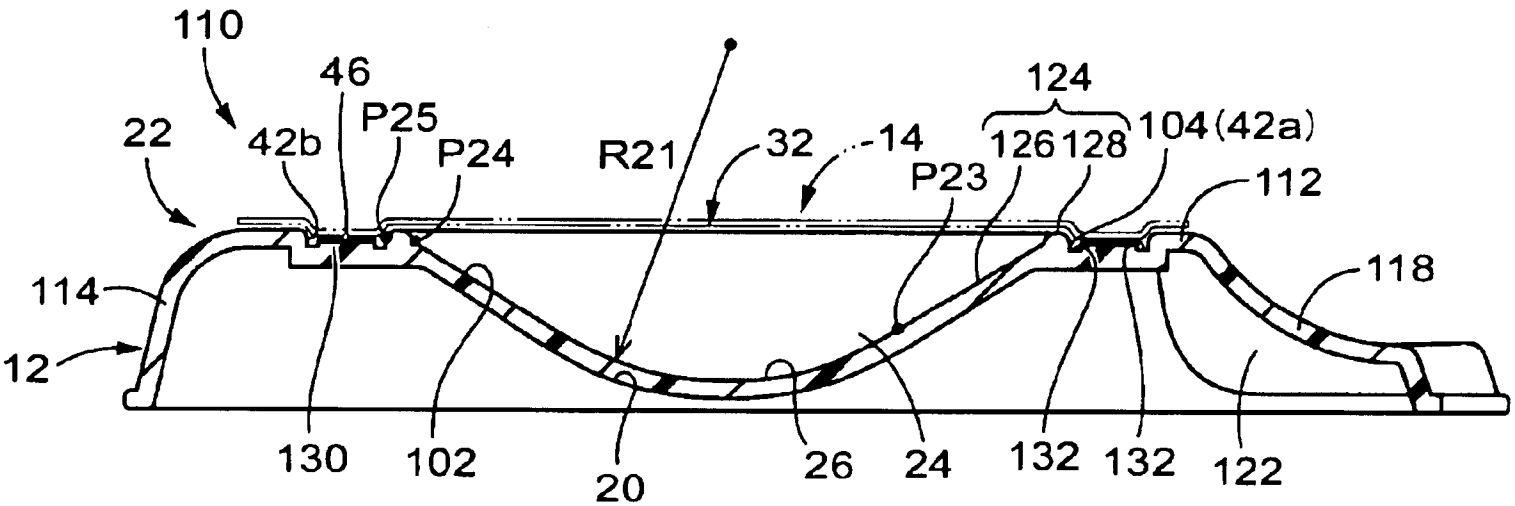
FIG. 24 is a cross sectional view taken along line 24—24 of FIG. 23.

Referring next to FIGS. 23 and 24, a blister package 110 is shown as an eighth embodiment of the ophthalmic lens storage container of the present invention. The blister package 110 is substantially different from the blister package 10 of the first embodiment, as to (i) the shape of the guide surface and (ii) the shape of the open-end peripheral portion in the opening 32 of the cavity 24.

In the blister package 110 of the present embodiment, the lens storage portion 20 has a generally semi-spherical shell shape that is made somewhat flat in a thickness direction, and the cavity 24 formed within the lens storage portion 20 has the bottom surface 26 whose inwardly curved or convex surface has a generally constant radius of curvature R21. The flange 22 comprises a plane surface 112 that surrounds the open-end peripheral portion of the cavity 24 and extends outwardly from the open-end peripheral portion of the cavity 24 in a direction perpendicular to the second direction along which the cavity 24 is open. The blister package 110 has a generally ellipsoidal shape in its entirety as seen in a plane view shown in FIG. 23. Further, a peripheral cylindrical wall 114 is integrally formed at the peripheral portion of the flange 22 so as to extend in the first direction that is opposed to the second direction along which cavity 24 is open.

A caudal-fin shaped portion 118 is integrally formed in one of opposite ends of the flange 22 in the main axis direction. The caudal-fin shaped portion 118 has an inwardly curved or concave shape in cross section as shown in FIG. 24, and is reinforced by rib 122, 122 integrally formed on its lower surface, and has a generally swallowtail shape in a plane view shown in FIG. 23, whereby the flange 22 has a fish-like shape in its entirety as seen in the plane view. The peripheral cylindrical wall 114 protrudes outward from the bottom of the lens storage portion 20 in the first direction. The protruding end of the cylindrical wall 114 is bent radially outward, to thereby provide an annular support surface.

In the present embodiment, a guide surface 124 consists of two parts, namely a sloped surface 126 as the first segment and an outwardly curved surface 128 as the second segment. The sloped surface 126 is continuously connected to the bottom surface 26 at knots P23 with no peak. As seen in the cross section of FIG. 24, the sloped surface 126 extends straightly from the knots P23 with a generally constant slope in the second direction, i.e., in the vertically upward direction. The outwardly curved surface 104 is formed in the open-end peripheral portion of the cavity 24, and has a generally semi circular shape in cross section so as to protrude outward in the second direction along which the cavity 24 is open. The outwardly curved portion 104 has a radius of curvature R22 (not shown) that is made sufficiently smaller than that of the bottom surface 26, and is connected at an inner peripheral portion to the sloped surface 126 along knots P24, and at an outer peripheral portion to the plane surface 112 along knots P25. The outwardly curved surface 128 is dimensioned so that the protruding end face is substantially flush with the plane surface 112. As is understood from the aforesaid description, the outwardly curved surface 128 serves as one of the segment of the guide surface, and functions to remove possible edges on the open-end peripheral portion of the cavity 24.

The flange 22 is further provided with the groove 104 disposed in the radially outward of the guide surface 124 and extending continuously in the circumferential direction over the entire circumference thereof. The groove 104 functioning as an insulating portion is open in the upper surface of the flange 22, and the inner circumferential wall 42*a* and outer circumferential wall 42*b* of the groove 104 function as the shoulder surface. The bottom surface of the groove 104 is provided with the base portion 130 protruding in the second direction formed in a central portion in the width direction and extending continuously in the circumferential direction over the entire circumference of the groove 104. Thus, the base portion 130 cooperates with the inner and outer circumferential walls 42*a*, 42*b* to form therebetween a pair of small grooves 132, 132 extending continuously over the circumference of the groove 104. The base portion 130 is dimensioned to have a height that is made smaller than the depth dimension of the groove 104.

The cover sheet 14 is superposed on and sealed to the base portion 130 by welding or the like. That is, the sealing zone 46 formed by the base portion 130 welded is substantially insulated from the guide surface 124 by the shoulder surface 42*a* of the groove 104. In particular, the fish-like shaped container body 12 can give a taste of design to the blister package 110.

Figure 25:
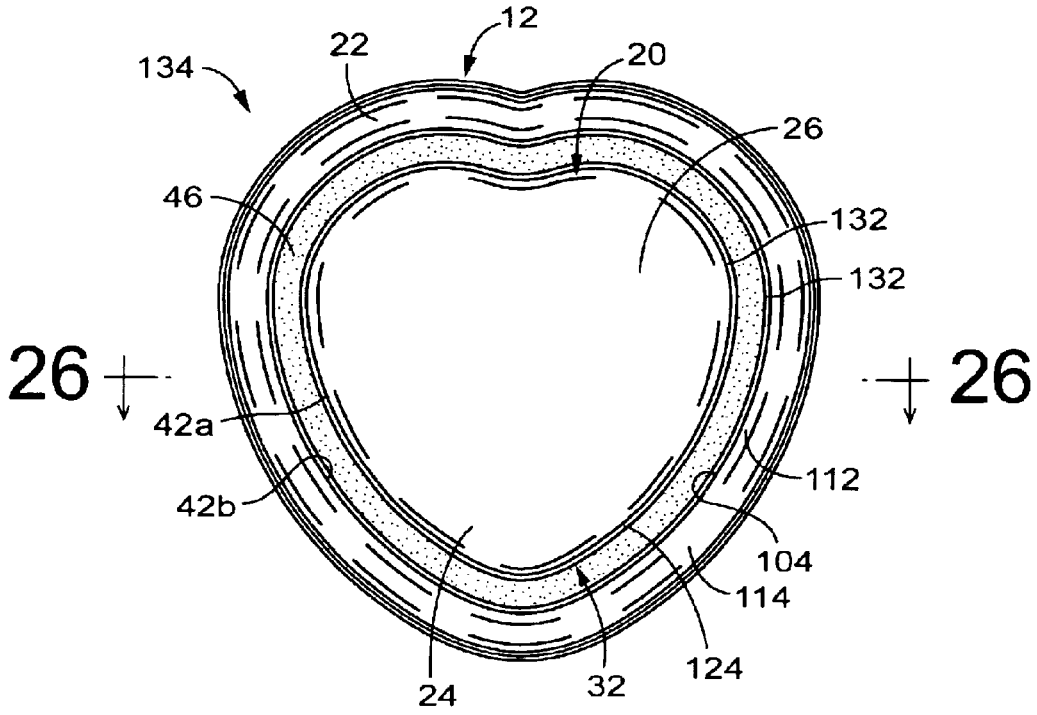
FIG. 25 is a top plane view of a blister package according to a ninth embodiment of the invention, where a cover sheet of the blister package is not secured.
Figure 26:
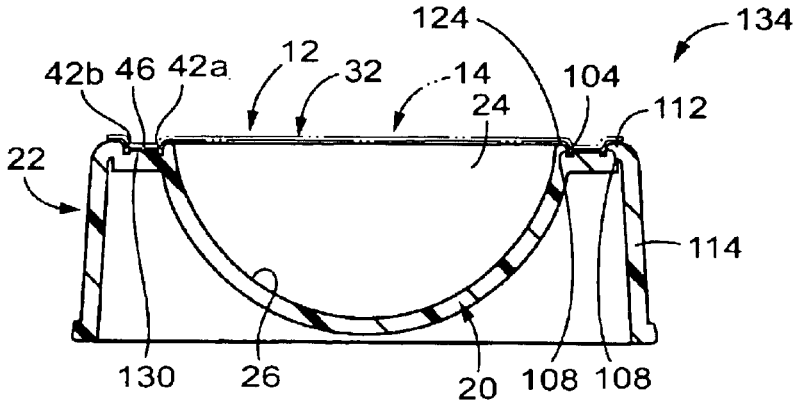
FIG. 26 is a cross sectional view taken along line 26—26 of FIG. 25.

Referring next to FIGS. 25 and 26, a blister package 134 is shown as a ninth embodiment of the ophthalmic lens storage container of the present invention. The blister package 134 is different from the blister package 110 of the eighth embodiment in the shape of the container body 12.

In the blister package 134, the bottom surface 26 has an inwardly curved or concave surface whose radius of curvature varies in the circumferential direction to have a generally heart shape in a plane view shown in FIG. 25. The flange 22 comprises a plane surface 112 that surrounds the open-end peripheral portion of the cavity 24 and extends outwardly from the open-end peripheral portion of the cavity 24 in a direction perpendicular to the second direction along which the cavity 24 is open (upward direction as seen in FIG. 26). The plane surface 112 also has a generally heart shape corresponding to and slightly larger than the cavity 24. The open-end peripheral portion of the cavity 24 is provided with a suitable radius to be chamfered. The cavity 24 has no apparent guide surface in the present embodiment, and the bottom surface 26 extends to the open-end peripheral portion of the cavity 24 with a generally constant radius of curvature, and is directly connected to the flange 22 (or the plane surface 112).

Like the eighth embodiment, the groove 104 functioning as the insulating portion is formed on the flange 22, to be located radially outward of the open-end peripheral portion of the cavity 24, and to extend in the circumferential direction continuously to thereby surround the cavity 24. The groove 104 includes the shoulder surface 42*a*, 42*b*, the base portion 130 and the smaller groove 132, 132, likewise. The shoulder surface 42 located on the side of the cavity 24 is partially defined by the outer peripheral portion of the bottom wall 26. Thus, the sealing zone 46 at which the cover sheet 14 is sealed to the container body 12 is set to the base portion 130 housed within the groove 104.

While the presently preferred embodiment of the invention has been described above in detail for illustrative purpose only, it is to be understood that the invention is not limited to the details of the illustrated embodiment, but may be otherwise embodied.

For instance, the container body may be provided with an upright peripheral wall or rib for the purpose of reinforcement, a hole or a cutout for assisting the user in lifting up the cover sheet from the flange or for reducing or balancing the weight of the container body, and an irregular surface for ensuring a non-slip grip of the container body by the user. The shape of the container body is not limited to the illustrated embodiment, but may have a variety of shapes.

The flange of the container body may be desirably shaped to be suitable in use and in packing the contact lens in the blister package, but not be limited to the illustrated ones.

The blister package is available for storing various kinds of ophthalmic lens for treating myopia, hyperopia, presbyopia and the like, such as hydrophilic or soft-type contact lenses including disposable contact lenses, hydrophobic or hard-type contact lenses, intraocular lenses. The blister package of the present invention is adoptable as an ophthalmic lens storage container for use in providing desired lenses to consumers or end users, or alternatively for use in providing desired lenses from manufacture to medical centers or the like.

It is also to be understood that the present invention may be embodied with various other changes, modifications and improvements, which may occur to those skilled in the art, without departing from the spirit and scope of the invention defined in the following claims.

What is claimed is:

1. An ophthalmic lens storage container comprising:

a container body including a lens storage portion having a cavity for storing an ophthalmic lens and a preserving solution, and a flange extending radially outward around an open-end peripheral portion of said cavity; and a cover sheet superposed on said container body for covering an opening of said cavity and being stripably sealed to said flange in a sealing zone that extends around said open-end peripheral portion of said cavity over an entire circumference of said cavity, to thereby fluid-tightly seal said lens storage portion;

wherein said flange of said container body includes an insulating portion located radially outward of said open-end peripheral portion of said cavity so as to extend circumferentially, said insulating portion has a shoulder surface that extends in a first direction opposite to a second direction along which said cavity is exposed, wherein said sealing zone to which said cover sheet is stripably sealed to said flange portion is exclusively located radially outward of said insulating portion of said flange, wherein and inner surface of said cavity includes a central portion and an open-end side portion that serves as a removal-guide surface whose radius of curvature is made different from that of said central portion, and wherein said removal-guide surface is smoothly connected to a plane surface extending in a direction perpendicular to said second direction, and being located axially upward of said sealing zone via said shoulder surface.

2. An ophthalmic lens storage container according to claim 1, wherein said flange of said container body further includes a lower surface spaced away from said opening of said cavity in said first direction, said lower surface serving for providing said sealing zone.

3. An ophthalmic lens storage container according to claim 1, wherein said insulating portion is constituted by a groove open in a front surface in which said cavity is open, and said shoulder surface is constituted by an inner circumferential wall surface of said groove.

4. An ophthalmic lens storage container according to claim 1, wherein said insulating portion, which is located radially outward of said open-end peripheral portion of said cavity, continuously extends over an entire circumference of said cavity.

5. An ophthalmic lens storage container according to claim 1, wherein said open-end peripheral portion of said cavity extends circumferentially with an outwardly curved shape in cross section.

6. An ophthalmic lens storage container according to claim 1, wherein said removal-guide surface consists of a plurality of segments having different radius of curvatures and being connected together in said second direction.

7. An ophthalmic lens storage container according to claim 1, wherein said removal-guide surface continuously extends over an entire circumference of said cavity.

8. An ophthalmic lens storage container according to claim 7, wherein said removal-guide surface has an outwardly curved shape in cross section.

9. An ophthalmic lens storage container according to claim 8, wherein said radius of curvature of said removal-guide surface is partially made larger at a circumferential portion as an intended lens removal portion.

10. An ophthalmic lens storage container according to claim 9, wherein said flange has a rectangular shape and said intended lens removal portion is approximately directed to a diagonal direction of said flange.

11. An ophthalmic lens storage container according to claim 1, wherein said insulating portion is located radially outward of said open-end peripheral portion of said cavity with a spacing in between, said spacing including a plane surface.

12. An ophthalmic lens storage container according to claim 1, wherein at least one circumferential portion of said sealing zone protrudes radially outward with a beak-like shape to thereby provide a beak-like portion.

13. An ophthalmic lens storage container according to claim 1, wherein at least one circumferential portion of said sealing zone extends radially outward to thereby provide a seal-retaining portion that allows said cover sheet, which is partially stripped from the flange to expose said cavity substantially entirely, to be retained in said flange.

14. An ophthalmic lens storage container according to claim 12, wherein said sealing zone extends radially outward to provide a seal-retaining portion at another circumferential portion that is opposed to said at least one circumferential portion where said beak-like portion is provided with said cavity interposed therebetween, said seal-retaining portion allows said cover sheet, which is partially stripped from said flange including said beak-like portion of said sealing zone to expose substantially entirely said cavity, to be retained in said flange.

15. An ophthalmic lens storage container according to claim 14, wherein said sealing zone includes a pair of said beak-like portions formed at respective circumferential positions thereof opposed to each other with said cavity interposed therebetween, and one of said pair of beak-like portion serves as said seal-retaining portion.

16. An ophthalmic lens storage container according to claim 1, wherein a width dimension of said sealing zone varies in a circumferential direction thereof so that said width dimension is maximized at two circumferential positions that are opposed to each other in one direction perpendicular to a direction along which said cover sheet is intended to be stripped off.

17. An ophthalmic lens storage container according to claim 1, wherein said flange is provided with at least one cutout in a periphery thereof.

18. An ophthalmic lens storage container according to claim 1, wherein said flange includes a peripheral wall that extends outward from a bottom of said lens storage portion in said first direction to be served as a support member.

* * * * *